US009170552B2

(12) United States Patent
Sakuma

(10) Patent No.: US 9,170,552 B2
(45) Date of Patent: Oct. 27, 2015

(54) IMAGE FORMING APPARATUS

(71) Applicant: Susumu Sakuma, Kasugai (JP)

(72) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/169,759

(22) Filed: Jan. 31, 2014

(65) Prior Publication Data

US 2014/0147164 A1 May 29, 2014

Related U.S. Application Data

(63) Continuation of application No. 13/539,789, filed on Jul. 2, 2012, now Pat. No. 8,682,209, which is a continuation of application No. 12/363,127, filed on Jan. 30, 2009, now Pat. No. 8,233,817.

(30) Foreign Application Priority Data

Jan. 31, 2008 (JP) ..... 2008-022143

(51) Int. Cl.

| | |
|---|---|
| ***G03G 15/20*** | (2006.01) |
| ***G03G 21/00*** | (2006.01) |
| ***G03G 15/16*** | (2006.01) |

(52) U.S. Cl.

CPC ..... *G03G 21/00* (2013.01); *G03G 15/168* (2013.01); *G03G 2215/0141* (2013.01); *G03G 2215/1661* (2013.01)

(58) Field of Classification Search

CPC . G03G 15/161; G03G 15/168; G03G 15/189; G03G 2215/1661; G03G 2215/132

USPC ..... 399/101

See application file for complete search history.

(56) References Cited

U.S. PATENT DOCUMENTS

| | | | |
|---|---|---|---|
| 6,029,033 | A | 2/2000 | Kawasaki |
| 6,640,079 | B2 | 10/2003 | Lim et al. |

(Continued)

FOREIGN PATENT DOCUMENTS

| | | | |
|---|---|---|---|
| CN | 1837982 | A | 9/2006 |
| JP | 04-215668 | A | 8/1992 |

(Continued)

OTHER PUBLICATIONS

European Search Report dated Jun. 10, 2009, application No. 09001108.1-2209.

(Continued)

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming apparatus includes: an image forming unit having a plurality of photoconductor drums arranged in tandem; a conveyor belt arranged opposite to the plurality of photoconductor drums and configured to convey a recording sheet; a cleaning unit having a cleaning member positioned in contact with the conveyor belt to collect substance adhering to the conveyor belt, and a receptacle configured to store the substance collected by the cleaning member, wherein the cleaning unit is arranged on the same side as the image forming unit with respect to the conveyor belt; and a positioning member configured to cause the cleaning member to be positioned at a contacting position where the cleaning member contacts with the conveyor belt and at a spaced-apart position where the cleaning member is away from the conveyor belt.

17 Claims, 12 Drawing Sheets

(56) References Cited

U.S. PATENT DOCUMENTS

| | | | | |
|---|---|---|---|---|
| 6,708,011 | B2 | 3/2004 | Nomura et al. | |
| 7,447,467 | B2 | 11/2008 | Kamimura et al. | |
| 7,593,664 | B2 | 9/2009 | Okabe | |
| 2006/0067734 | A1 | 3/2006 | Igarashi et al. | |
| 2006/0216056 | A1 | 9/2006 | Okabe | |
| 2006/0284967 | A1* | 12/2006 | Nomura et al. | 347/238 |
| 2007/0217816 | A1 | 9/2007 | Shiraki | |
| 2008/0008481 | A1* | 1/2008 | Takahashi et al. | 399/27 |
| 2008/0205946 | A1 | 8/2008 | Kim et al. | |
| 2008/0267661 | A1* | 10/2008 | Yoshida et al. | 399/120 |
| 2009/0196652 | A1 | 8/2009 | Sakuma | |
| 2009/0238585 | A1 | 9/2009 | Hayashi et al. | |

FOREIGN PATENT DOCUMENTS

| | | | |
|---|---|---|---|
| JP | H04-284468 | A | 10/1992 |
| JP | 05-257340 | A | 8/1993 |
| JP | 2003-015378 | A | 1/2003 |
| JP | 2004246011 | A | 9/2004 |
| JP | 2006098772 | A | 4/2006 |
| JP | 2006-154195 | A | 6/2006 |
| JP | 2006-171295 | A | 6/2006 |
| JP | 2007094445 | A | 4/2007 |
| JP | 2007-256352 | A | 10/2007 |
| JP | 2008-015365 | A | 1/2008 |
| JP | 2009-020464 | A | 1/2009 |
| JP | 2009-181077 | A | 8/2009 |
| JP | 2009237560 | A | 10/2009 |

OTHER PUBLICATIONS

Office Action received in Chinese patent application No. 200910003773.4 mailed Jun. 9, 2010.

Office Action received in counterpart JP Application No. 2008-022143, mailed Feb. 16, 2010.

Notification of Second Office Action for Chinese patent application No. 200910003773.4 mailed Mar. 9, 2011.

Notification of Reasons for Refusal for Japanese Patent applicaiton No. 2010-151825 mailed Oct. 12, 2010.

Notification of Reasons for Refusal for Japanese Patent application No. 2010-151825 mailed Dec. 7, 2010.

* cited by examiner

IMAGE FORMING APPARATUS

CROSS REFERENCE TO RELATED APPLICATION

This application is a continuation of U.S. patent application Ser. No. 13/539,789 filed Jul. 2, 2012, which is a continuation of U.S. patent application Ser. No. 12/363,127 filed on Jan. 30, 2009, issued as U.S. Pat. No. 8,233,817, which claims priority to and foreign priority benefit under Title 35, United States Code, section 119(a)-(d) of Japanese Patent Application No. 2008-022143 filed on Jan. 31, 2008 in the Japan Patent Office. The disclosures of the above noted applications are herein incorporated by reference in their entirety.

BACKGROUND OF THE INVENTION

The present invention relates to an image forming apparatus such as a color laser printer.

An image forming apparatus such as a laser printer is generally known, which comprises a plurality of development devices each containing different color toner, a plurality of photoconductor drums each of which is supplied with toner from a corresponding development device via a developing roller, a belt arranged opposite to the plurality of photoconductor drums, and a plurality of transfer devices configured to cause toner retained on the plurality of photoconductor drums to be attracted to the belt. In this image forming apparatus, the plurality of photoconductor drums are arranged in tandem, and a sheet is conveyed on the belt and passes between the plurality of photoconductor drums and the plurality of transfer devices, during which a transfer bias having the reverse polarity of the charged toner is applied to the transfer devices so that different color toner retained on the surfaces of the respective photoconductor drums is attracted by the transfer devices and continuously transferred onto the sheet to perform a color printing on the sheet.

According to this image forming apparatus, in order to ease maintenance of the photoconductor drums, each of the photoconductor drums for different colors is integrally held in a photoconductor drum unit, and this photoconductor drum unit is attached to or detached from a main body of the image forming apparatus. Further, in order to remove adhering substance such as toner and paper dust adhering to the conveyor belt due to sheet jamming, etc., the image forming apparatus is also provided with a cleaning unit configured to contact with the conveyor belt to remove and collect the adhering substance.

For example, Japanese Laid-open Patent Publication No. 2006-98772, which corresponds to US 2006/0067734 A1, discloses an image forming apparatus in which a photoconductor drum unit is arranged above the conveyor belt and a cleaning unit is arranged at a lower position of the conveyor belt where a sheet does not pass through.

An image forming apparatus equipped with a cleaning unit requires maintenance of the cleaning unit in order to dispose of adhering substance that has been removed and collected from the conveyor belt.

However, in the above conventional image forming apparatus, because the cleaning unit is arranged below the conveyor belt, it is necessary to remove the conveyor belt during the maintenance of the cleaning unit. Therefore, the maintenance work becomes complicated and time-consuming.

Further, according to an arrangement where the photoconductor drum unit is arranged above the conveyor belt and the cleaning unit is arranged below the conveyor belt, the height of the image forming apparatus is increased and thus the overall size of the image forming apparatus is enlarged.

In view of the foregoing drawbacks of the prior art, the present invention seeks to provide an image forming apparatus, which can ease the maintenance work of the cleaning unit and which can reduce the overall size of the image forming apparatus.

SUMMARY OF THE INVENTION

According to the present invention, an image forming apparatus comprises: an image forming unit including a plurality of photoconductor drums arranged in tandem; a conveyor belt arranged opposite to the plurality of photoconductor drums and configured to convey a recording sheet; a cleaning unit including a cleaning member positioned in contact with the conveyor belt to collect substance adhering to the conveyor belt, and a receptacle configured to store the substance collected by the cleaning member, wherein the cleaning unit is arranged on the same side as the image forming unit with respect to the conveyor belt; and a positioning member configured to cause the cleaning member to be positioned at a contacting position where the cleaning member contacts with the conveyor belt and at a spaced-apart position where the cleaning member is away from the conveyor belt.

According to this image forming apparatus, because the cleaning unit for the conveyor belt is arranged on the same side as the image forming unit with respect to the conveyor belt, the maintenance of the cleaning unit can be performed by the same manner of operations as the image forming unit is attached to or detached from the main body of the image forming apparatus. Further, because the cleaning member can be positioned at the contacting position and at the spaced-apart position with respect to the conveyor belt, it is possible that the cleaning unit is positioned away from the conveyor belt during the conveyance of a recording sheet and positioned in contact with the conveyor belt when no recording sheet is conveyed on the conveyor belt. Therefore, even if the cleaning unit is arranged on the same side as the image forming unit with respect to the conveyor belt, the cleaning unit does not interfere with the conveyance of recording sheets.

According to the present invention, the maintenance work for the cleaning unit can be readily performed and the overall size of the image forming apparatus can be reduced.

BRIEF DESCRIPTION OF THE DRAWINGS

Other objects and aspects of the present invention will become more apparent by describing in detail illustrative, non-limiting embodiments thereof with reference to the accompanying drawings, in which:

FIGS. 9A and 9B show main parts of a color printer according to a third embodiment of the present invention, in which FIG. 9A is a sectional view showing a cleaning unit in an assembled state, and FIG. 9B is a sectional view showing the cleaning unit in a separated state;

FIGS. 10A and 10B show main parts of a color printer according to a fourth embodiment of the present invention, in which FIG. 10A is an enlarged sectional view showing a state in which a developing cartridge has been attached to a drawer frame, and FIG. 10B is an enlarged sectional view showing a state in which the developing cartridge has been removed from the drawer frame;

DETAILED DESCRIPTION OF THE INVENTION

Preferred embodiments of the present invention will be described in detail with reference to the attached drawings.

Figure 1:
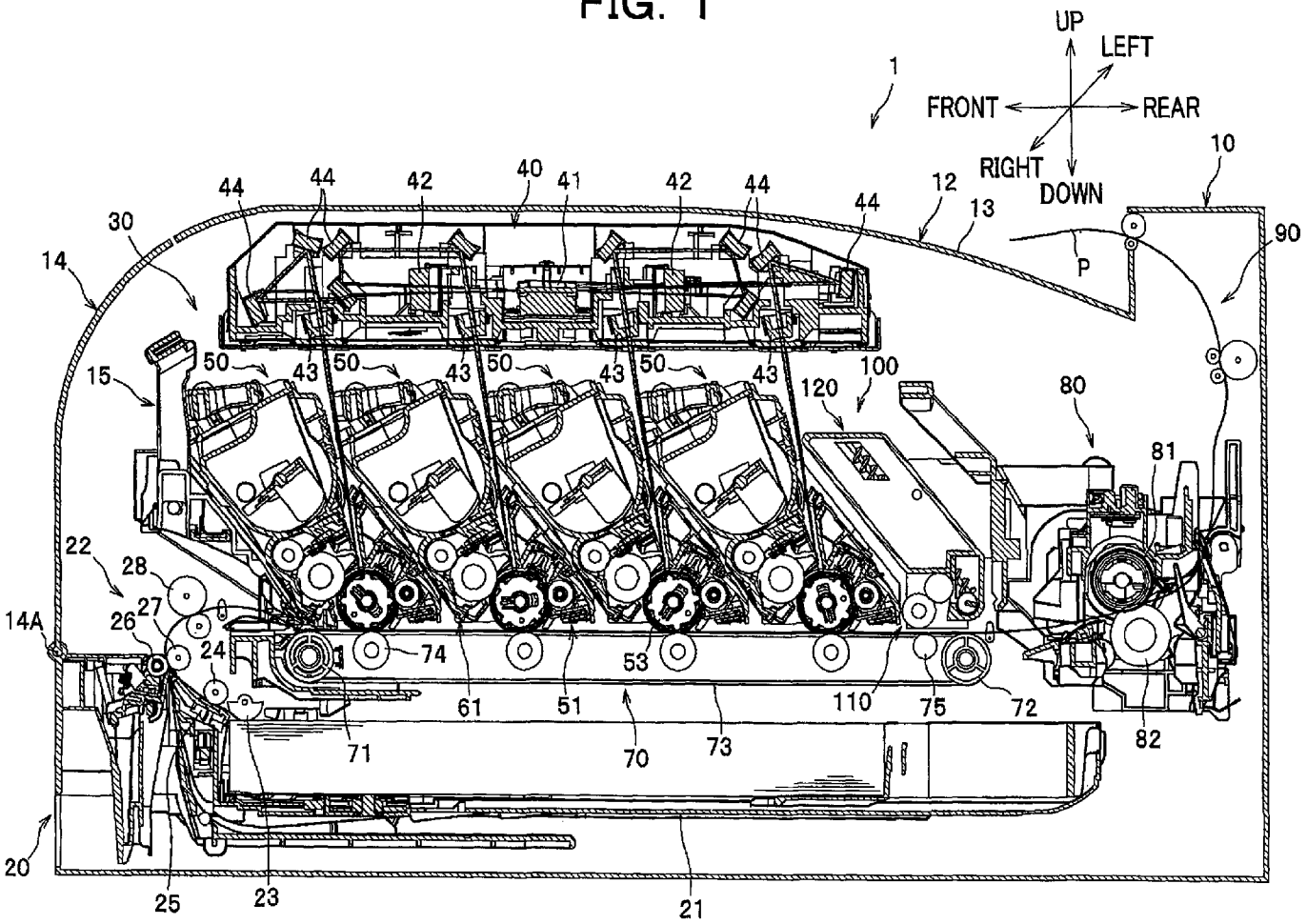
FIG. 1 is a sectional view showing the overall configuration of a color printer as an example of an image forming apparatus according to a first embodiment of the present invention.

In the following description, unless otherwise stated, directions of the color printer refer to the directions as seen from a user facing the color printer during its use. To be more specific, referring to FIG. 1, a left-side direction and a right-side direction of the color printer are referred to as a "front side" and a "rear side", respectively. Also, a direction away from a viewer of FIG. 1 is referred to as a "left side", and a direction toward the viewer of FIG. 1 as a "right side". An upper and lower direction in FIG. 1 is referred to as a "vertical direction" or an "upper and lower direction" as it is.

First Embodiment

As seen in FIG. 1, a color printer 1 has a main body 10. A sheet feeding unit 20 configured to feed a sheet of paper P (hereinafter simply referred to as a "sheet" P) as an example of a recording sheet, an image forming device 30 configured to form an image on the sheet P supplied from the sheet feeding unit 20, and a sheet output unit 90 configured to discharge the sheet P having the image thereon from the main body 10 are arranged in the main body 10.

An upper cover 12 is provided at an upper part of the main body 10. Also, a front cover 14 is provided at a front part of the main body 10. The front cover 14 is pivotally supported on a hinge 14A that is provided at a lower part of the main body 10. The front cover 14 is swung in the front-and-rear direction around the hinge 14A so as to be opened and closed. The upper surface of the upper cover 12 provides a sheet output tray 13 for receiving and stacking sheets P discharged from the main body 10. A scanner unit 40 to be described later is arranged below the upper cover 12.

The sheet feeding unit 20 is arranged at a lower part of the main body 10, and mainly includes a sheet feed tray 21 configured to be attached to or detached from the main body 10, and a sheet feed mechanism 22 configured to convey a sheet P from the sheet feed tray 21 to the image forming device 30. The sheet feed mechanism 22 is positioned in front of the sheet feed tray 21, and mainly includes a feed roller 23, a separation roller 24, and a separation pad 25.

The sheet feeding unit 20 as constructed above separates a stack of sheets P stored in the sheet feed tray 21 and conveys a sheet P on one-by-one basis upwardly toward the image forming device 30, during which the sheet P passes between a paper dust removing roller and a pinch roller 27 to remove paper dust from the sheet P and thereafter the sheet conveyance direction of the sheet P is reversed in the rearward direction past a conveyance roller 28.

The image forming device 30 mainly includes a scanner unit 40, four process cartridges 50 as an example of an image forming unit, a cleaning unit 100, a transfer unit 70, and a fixing unit 80.

The four process cartridges 50 and the cleaning unit 100 are mounted to a drawer frame 15 which is attached to or detached from the main body 10. The drawer frame 15 is formed, for example, as a bottomless frame. The drawer frame 15 can be pulled out from the main body 10 with the front cover 14 being opened.

The scanner unit 40 is arranged at an upper part in the main body 10, and includes laser emitting portions (not shown), a polygon mirror 41 that is driven to spin at high speeds, a plurality of lenses 42, 43, and a plurality of reflecting minors 44. A laser beam is emitted from the laser emitting portion based on an image data. As seen in FIG. 1, the laser beam associated with one of the colors including, for example, cyan, magenta, yellow, and black is reflected by or passes through the polygon mirror 41, the lens 42, the reflecting mirrors 44 associated with the color, and the lens 43 associated with the color in this order. Thereafter, the surface of the photoconductor drum 53 of the corresponding process cartridge 50 is illuminated with the light (i.e., scanned at a high speed).

Figure 2:
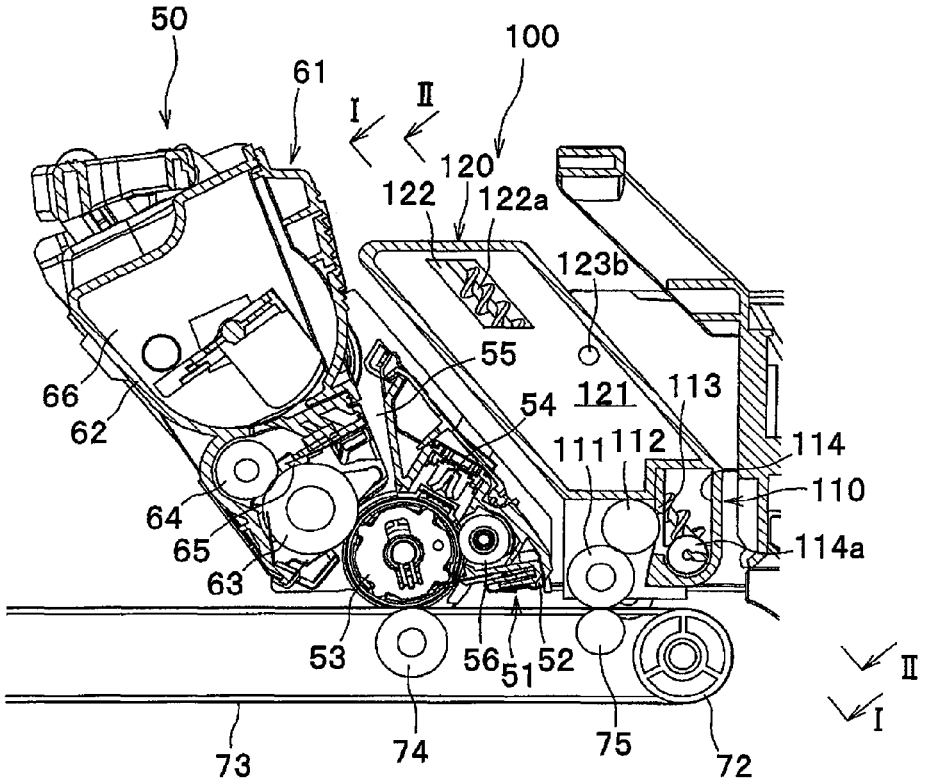
FIG. 2 is an enlarged sectional view showing main parts of a process cartridge and a cleaning unit.

The process cartridges 50 are positioned between the scanner unit 40 and the transfer unit 70 and arranged in line along the front-and-rear direction. As seen in FIG. 2, each of the process cartridges 50 includes a photoconductor cartridge 51, and a developing cartridge 61 as an example of a developer cartridge that is detachably attached to the photoconductor cartridge 51. The process cartridges 50 are detachably mounted to the drawer frame 15.

The photoconductor cartridge 51 mainly includes a drum frame 52, a photoconductor drum 53 rotatably supported on the drum frame 52, a charger 54, and a cleaning roller 56.

The drum frame 52 is configured such that when the developing cartridge 61 is attached to the photoconductor cartridge 51, an exposure opening 55 is defined between the developing cartridge 61 and the photoconductor cartridge 51, through which opening the photoconductor drum 53 can be seen from above. A laser beam coming from the lens 43 of the scanner unit 40 through the exposure opening 55 strikes the surface of the photoconductor drum 53. The cleaning roller 56 is rotatable and positioned in contact with the photoconductor drum 53. When a predetermined electric voltage is applied to the cleaning roller 56, the cleaning roller 56 temporarily collects and retains toner T that has remained on the photoconductor drum 53 after toner T is transferred onto the sheet P.

The developing cartridge 61 includes a developer frame 62, a developing roller 63 and a supply roller 64 rotatably supported on the developer frame 62, a doctor blade 65, and a toner storage chamber 66 for storing toner T.

It is noted that each of the developing cartridges 61 is substantially the same in construction except for the color of toner (developer) T stored in the toner storage chamber 66.

As seen in FIG. 1, the transfer unit 70 is positioned between the sheet feeding unit 20 and the process cartridges 50, and mainly includes a drive roller 71, a driven roller 72, a conveyor belt 73, and transfer rollers 74.

The drive roller 71 and the driven roller 72 are positioned parallel to each other and spaced apart in the front-and-rear direction. The conveyor belt 73 in the form of an endless belt is looped around the drive roller 71 and the driven roller 72. The outer surface of the conveyor belt 73 contacts with the photoconductor drums 53. Four transfer rollers 74 are positioned inside the conveyor belt 73 opposite to the corresponding photoconductor drums 53 with the conveyor belt 73 being interposed therebetween. A transfer bias is applied to each transfer roller 74 by a constant-current control during the transfer of toner T onto the sheet P.

A backup roller 75 is also positioned inside the conveyor belt 73 opposite to a cleaning roller 111 of a cleaning unit 100 to be described later.

The fixing unit 80 is arranged behind the process cartridges 50 and the transfer unit 70. The fixing unit 80 includes a heating roller 81, and a pressure roller 82 positioned opposite to the heating roller 81 and pressing the heating roller 81.

The cleaning unit 100 collects or removes toner T adhering to the conveyor belt 73 as an example of adhering substance. The cleaning unit 100 is arranged behind the plurality of process cartridges 50 in a position parallel to these process cartridges 50. In other words, the cleaning unit 100 is arranged downstream from the plurality of process cartridges 50 (i.e., the image forming unit) as seen in a sheet conveyance direction along which a sheet P is conveyed on the conveyor belt 73. The cleaning unit 100 includes a cleaner portion 110 configured to collect toner T adhering to the conveyor belt 73, and a waste toner box 120 as an example of a receptacle for storing the collected toner T. As with the process cartridges 50, the cleaning unit 100 is also detachably mounted to the drawer frame 15.

Other than paper jamming, toner T adheres to the conveyor belt 73 during a so-called patch test for testing shading, color tone, and color shift of printed patterns.

Figure 3:
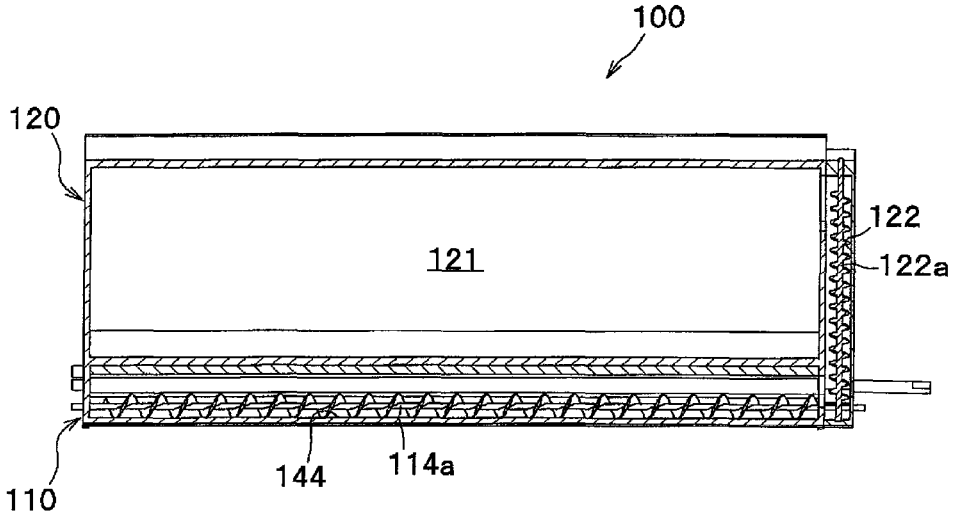
FIG. 3 is a sectional view taken along the line I-I of FIG. 2.

As seen in FIGS. 2 and 3, the cleaner portion 110 includes a cleaning roller 111 as an example of a cleaning member, a collecting roller 112, a blade 113, and a carrier unit 114.

The cleaning roller 111 contacts with the conveyor belt 73 to remove toner T from the conveyor belt 73. The cleaning roller 111 is a conductive foamed roller. The cleaning roller 111 consists of a roller shaft made of metal, and a roller member coating the roller shaft and made of a conductive foamed material such as silicone foam and urethane foam. The cleaning roller 111 is configured to be displaced between a contacting position where the cleaning roller 111 contacts with the conveyor belt 73 and a spaced-apart position where the cleaning roller 111 is away from the conveyor belt 73.

The collecting roller 112 is made of a hard material such as metal and pressed against the cleaning roller 111. The collecting roller 112 is rotatable and arranged upward behind the cleaning roller 111. The blade 113 is provided at the rear of the collecting roller 112. The blade 113 contacts with the collecting roller 112 with a pressure and scrapes toner T off from the surface of the collecting roller 112. The carrier unit 114 defines a passage for carrying the toner T that has been scraped off by the blade 113 to the waster toner box 120. A first auger 114*a* extending in the right-and-left direction is arranged inside the carrier unit 114.

The waste toner box 120 includes a storage portion 121 for storing collected toner T, and a waste toner loading portion 122 configured to load waste toner T from the cleaner portion 110 into the storage portion 121. The storage portion 121 is substantially in the form of a parallelogram as seen from a side section, and the lower end of the storage portion 121 is connected to the cleaner portion 110. The waste toner loading portion 122 is a passage for connecting the carrier unit 114 and the storage portion 121. A second auger 122*a* is provided inside the waste toner loading portion 122 and extends diagonally in the vertical direction. The waste toner loading portion 122 is positioned at the left side of the carrier unit 114 and the storage portion 121.

Figure 4:
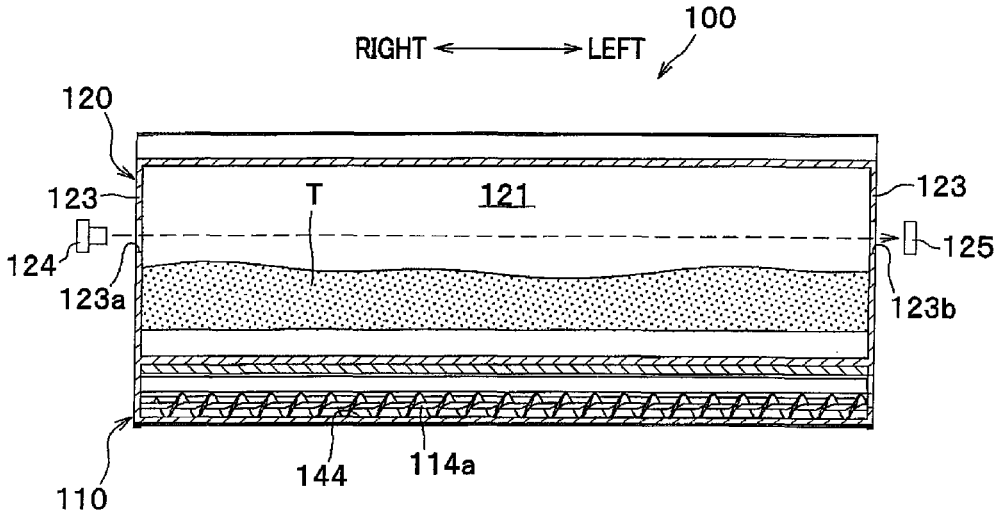
FIG. 4 is a sectional view taken along the line II-II of FIG. 2.

As seen in FIG. 4, a light emitting portion 124 is provided at the right side of the waste toner box 120 (i.e., left side in FIG. 4). The light emitting portion 124 emits a light beam for measuring the amount of waste toner T stored in the waste toner box 120. A light receiving portion 125 for receiving the light beam from the light emitting portion 124 is provided at the left side of the waste toner box 120. Light transmission windows 123*a*, 123*b* are formed in the right and left walls 123 of the waste toner box 120, through which windows the light beam from the light emitting portion 124 passes through the waste toner box 120 and received by the light receiving portion 125.

Figure 5A:
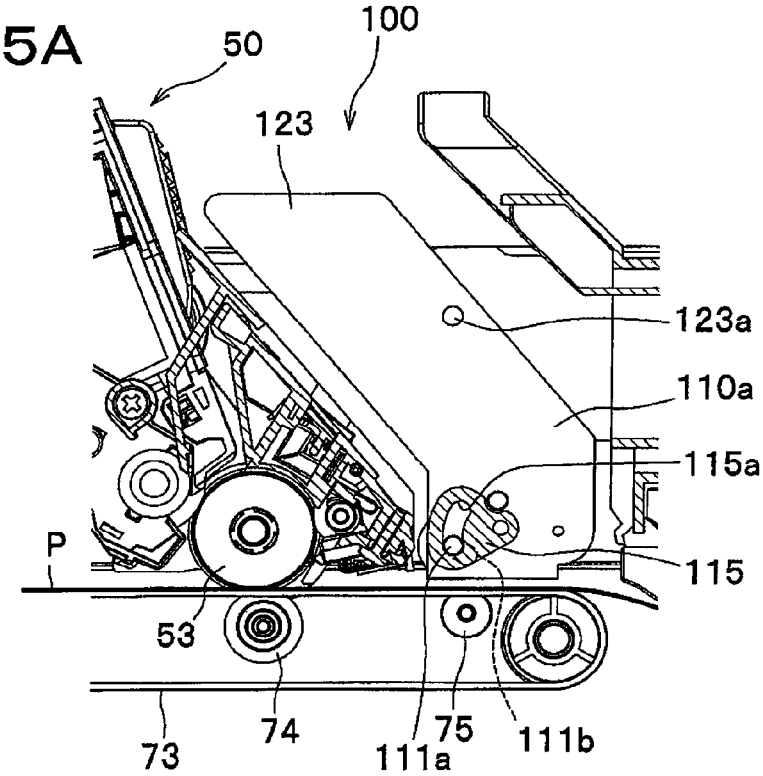
FIGS. 5A and 5B are side views showing the cleaning unit.
Figure 5B:
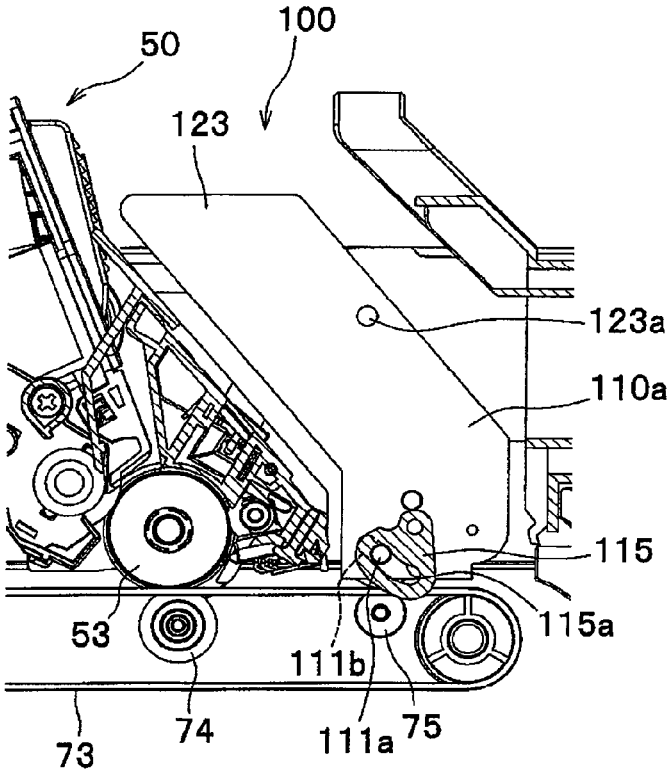

As best seen in FIG. 5, a rocking member 115 is provided at each side wall 110*a* (right and left side walls) of the cleaner portion 110 (only the right-side wall is shown in FIGS. 5A and 5B) The rocking members 115 cause the cleaning roller 111 to be positioned in contact with or away from the conveyor belt 73. An oblong hole 111*b* for rotatably supporting the rotation shaft 111*a* of the cleaning roller 111 is formed in each side wall 110*a*. The oblong hole 111*b* extends substantially along the rocking direction of the rocking member 115. The rocking member 115 is substantially in the shape of a sector and one end portion (remote from the arc of the sector) of the rocking member 115 is pivotally supported on the side wall 110*a*. The pivot shaft of the rocking member 115 is coaxial with the rotation shaft of the collecting roller 112. Therefore, the cleaning roller 111 is capable of rocking around the rotation shaft of the collecting roller 112 and reliably positioned in contact with or away from the conveyor belt 73.

An arc-shaped engagement hole 115*a* is formed in the rocking member 115 at the other end (close to the arc of the sector) of the rocking member 115. The engagement hole 115*a* engages an end of the rotation shaft 111*a* protruding through the oblong hole 111*b*. The rocking member 115 is provided at each side (right and left sides) of the cleaner portion 110.

A sheet detecting sensor (not shown) for detecting passage of a sheet is provided between the conveyance roller 28 and the conveyor belt 73 and between the conveyor belt 73 and the fixing unit 80, respectively.

A controller (not shown) controls the cleaning roller 111 based on detecting signals from the two sheet detecting sensors. Based on the detecting signals, the controller determines whether a sheet P is being conveyed on the conveyor belt 73 between the two sheet detecting sensors. The controller causes the cleaning roller 111 to be positioned away from the conveyor belt 73 when a sheet P is conveyed between the two sheet detecting sensors and to be positioned in contact with the conveyor belt 73 when no sheet is conveyed between the two sheet detecting sensors. As an example, the cleaning roller 111 is moved away from the conveyor belt 73 at a time when the leading end of a sheet P passes through the photoconductor drum 53 that is positioned in front of the cleaning roller 111. As described later in detail and in certain cases, the controller causes the cleaning roller 111 to be positioned in contact with or away from the conveyor belt 73 notwithstanding the presence or absence of a sheet P between the two sheet detecting sensors.

According to the image forming unit 30 as constructed above, the surface of each photoconductor drum 53 is positively and uniformly charged by the corresponding charger 54, followed by exposure to a laser beam emitted from the scanner unit 40 in accordance with a subject color of the photoconductor drum 53. Therefore, the electric potential of the exposed area lowers so that an electrostatic latent image associated with an image data is formed on the surface of the photoconductor drum 53.

When the supply roller 64 rotates, toner T stored in the toner storage chamber 66 is supplied to the developing roller 63, thereafter by the rotation of the developing roller 63 the toner T moves between the developing roller 63 and the doctor blade 65 at which position the toner T is carried on the developing roller 63 as a thin layer having a constant thickness. It is noted that the toner T carried on the surface of the developing roller 63 is charged positively between the supply roller 64 and the developing roller 63 and also between the developing roller 63 and the doctor blade 65.

The toner T carried on the developing roller 63 moves onto the latent image that is formed on the photoconductor drum 53 when the developing roller 63 opposite to the photoconductor drum 53 contacts with the surface of the photoconductor drum 53. Therefore, the toner T is selectively supplied on the surface of the photoconductor drum 53 to visualize the latent image. Atoner image is formed by this reversal process.

Toner images formed on the plurality of photoconductor drums 53 are transferred onto a sheet P while the sheet P is conveyed on the conveyor belt 73 and passes between the photoconductor drums 53 and the transfer rollers 74 that are arranged inside the conveyor belt 73 corresponding to the photoconductor drums 53. When the sheet P passes between the heating roller 81 and the pressure roller 82, the toner images transferred on the sheet P are thermally fixed.

As seen in FIG. 1, the sheet output unit 90 includes plural pairs of conveyance rollers along an output-side sheet conveyance passage and at the discharge opening for sheets P. The sheet P onto which the toner images have been transferred and fixed by heat is conveyed along the output-side sheet conveyance passage by means of the conveyance rollers, discharged from the main body 10, and stacked on the sheet output tray 13.

Operation of the cleaning unit will be described below with reference to FIGS. 5A and 5B.

As best seen in FIG. 5A, when a sheet P is being conveyed on the conveyor belt 73, the controller determines from the output signals of the two sheet detecting sensors that a sheet P is on the conveyer belt 73 between the two sheet detecting sensors. The controller then transmits an operating signal to an actuator (not shown) that is connected to the rocking member 115, so that the rocking member 115 is pivotally moved upward. By this movement of the rocking member 115 the cleaning roller 111 is lifted in a direction away from the conveyor belt 73 through the rotation shaft 111*a* engaged with the rocking member 115. Therefore, the cleaning roller 111 does not interfere with the conveyance of the sheet P.

As best seen in FIG. 5B, when no sheet is being conveyed on the conveyor belt 73, the controller determines from the output signals of the two sheet detecting sensors that a sheet P is not on the conveyor belt 73. If other conditions for initiating a cleaning operation are satisfied, the controller transmits an operating signal to the actuator (not shown) that is connected to the rocking member 115, so that the rocking member 115 is pivotally moved downward. By this movement of the rocking member 115 the cleaning roller 111 is positioned in contact with the conveyor belt 73 through the rotation shaft 111*a* engaged with the rocking member 115. Therefore, the conveyor belt 73 can be cleaned by the cleaning roller 111.

Next, operation of the cleaning unit not based on the outputs of the sheet detecting sensors will be described below.

The controller (not shown) transmits an operating signal to the actuator (not shown) that is connected to the rocking member 115 at a time when the main power switch of the color printer 1 is turned on or when the front cover 14 is closed after fixing a paper jam or after replacement of various cartridges, so that the rocking member 115 is pivotally moved upward. By this movement of the rocking member 115 the cleaning roller 111 is lifted and positioned away from the conveyor belt 73 through the rotation shaft 111*a* a engaged with the rocking member 115. In this position of the cleaning roller 111, the conveyor belt 73 and other sheet conveyance means are driven for a predetermined period of time. Therefore, even if a sheet P remains in the color printer 1, the sheet P can be discharged from the main body 10 onto the sheet output tray 13. In this instance, because the cleaning roller 111 is positioned away from the conveyor belt 73, the cleaning roller 111 does not interfere with the discharge of the sheet P. This series of operations is called as a "sheet discharging mode." The controller then transmits an operating signal to the actuator (not shown) that is connected to the rocking member 115, so that the rocking member 115 is pivotally moved downward. By this movement of the rocking member 115 the cleaning roller 111 is moved downward and positioned in contact with the conveyor belt 73 trough the rotation shaft 111*a* engaged with the rocking member 115. In this position of the cleaning roller 111, the controller causes the conveyor belt 73 to run.

The roller shaft of the backup roller 75 is earthed, and a negative bias is applied to the cleaning roller 111 and a negative bias lower than that applied to the cleaning roller 111 is applied to the collecting roller 112. Therefore, toner T adhering to the conveyor belt 73 moves to the cleaning roller 111 by the action of the bias attraction force and the contacting force of the cleaning roller 111 at around the opposing position of the cleaning roller 111 and the backup roller 75. The toner T carried on the cleaning roller 111 is then moved to the collecting roller 112 by the action of the bias attraction force, and thereafter the toner T carried on the collecting roller 112 is scraped off by the blade 113 and finally supplied into the carrier unit 114. The toner T supplied into the carrier unit 114 is carried to the waste toner loading portion 122 by the first auger 114*a*. The toner T carried to the waste toner loading portion 122 is then supplied into the storage portion 121 by the second auger 122*a* and stored in the storage portion 121.

During this process, a predetermined electric voltage (i.e., a positive bias for moving positively charged toner T toward the photoconductor drum 53) is applied to the cleaning roller 56 provided in the photoconductor cartridge 51 for a predetermined period of time so that the toner T is returned to the photoconductor drum 53. A negative transfer bias is applied to the transfer roller 74 so that the toner T that has been returned to the surface of the photoconductor drum 53 is moved and discharged onto the conveyor belt 73. Thereafter, the toner T moves to the cleaning roller 111 by the rotation of the conveyor belt 73 and is collected by the cleaning roller 111. The collected toner T is stored in the storage portion 121 of the waste toner box 120. Accordingly, removal of the toner T that is temporarily retained by the cleaning roller 56 is completed. This series of operations is called as a "cleaning mode."

Next, the scanner unit 40 forms an electrostatic latent image having a predetermined patch pattern on the surface of the photoconductor drum 53. This latent image is developed using toner T carried on the developing roller 63. The patch pattern developed by the toner T is then transferred on the conveyor belt 73 by applying a negative transfer bias to the transfer roller 74.

The resulting patch pattern passes through a patch pattern sensor (not shown) by the rotation of the conveyor belt 73.

The patch pattern sensor performs various measurements. The patch pattern sensor is arranged below the driven roller 72 at a position opposite to the driven roller 72 with the conveyor belt 73 interposed therebetween. The patch sensor comprises a light emitting element and a light receiving element, and measures, for example, image density and color shift between respective colors.

The cleaning roller 111 is controlled to be positioned away from the conveyor belt 73 when the patch pattern formed on the conveyor belt 73 passes through the cleaning roller 111. Therefore, the cleaning roller 111 does not soil the patch pattern.

At a predetermined time after the patch pattern has completely passed through the opposing position between the cleaning roller 111 and the driven roller 72, the cleaning roller 111 is controlled to be positioned in contact with the conveyor belt 73. Therefore, toner T forming the patch pattern goes around on the conveyor belt, and is collected by the cleaning roller 111 and stored in the storage portion 121 of the waste toner box 120. This series of operations is called as a "patch pattern measurement mode."

These three modes of operations including the sheet discharging mode, the cleaning mode, and the patch pattern measurement mode are referred to as a series of start-up operations implemented immediately after turning on the main power switch and immediately after opening and closing the front cover.

The patch pattern sensor may be arranged between the photoconductor drum 53 and the cleaning roller 111. In this arrangement of the patch pattern sensor, although the image forming apparatus becomes longer in size in the front-and-rear direction, the required time for the patch pattern measurement mode can be advantageously shortened because the patch pattern does not have to go around on the conveyor belt 73.

As best seen in FIG. 4, when a measuring beam light emitted from the light emitting portion 124 is blocked by toner T that is stored in the storage portion 121 and not sensed by the light receiving portion 125, the controller (not shown) causes a display device provided on the main body 10 to display a message for encouraging the user to perform maintenance of the cleaning unit 100.

Maintenance of the cleaning unit 100 will be described below with reference to FIGS. 6 and 7.

Figure 6:
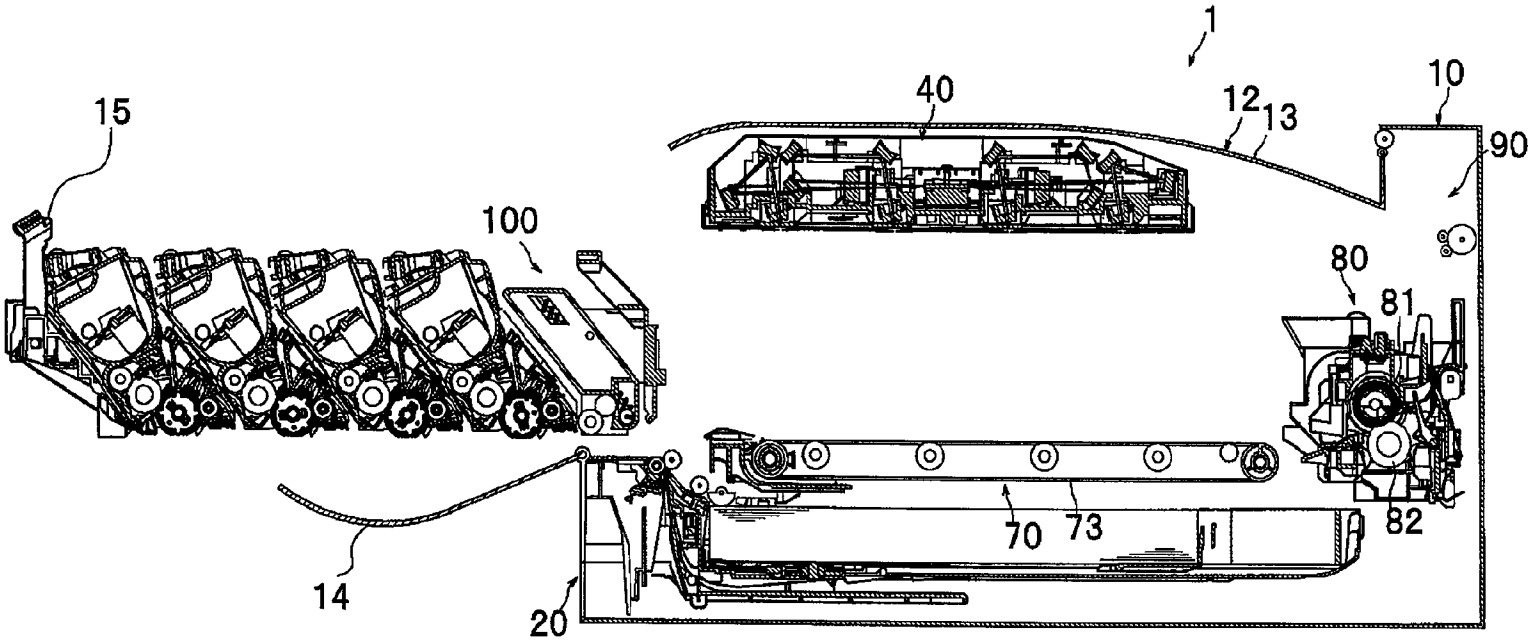
FIG. 6 is a sectional view showing a state in which a drawer unit has been pulled out.
Figure 7:
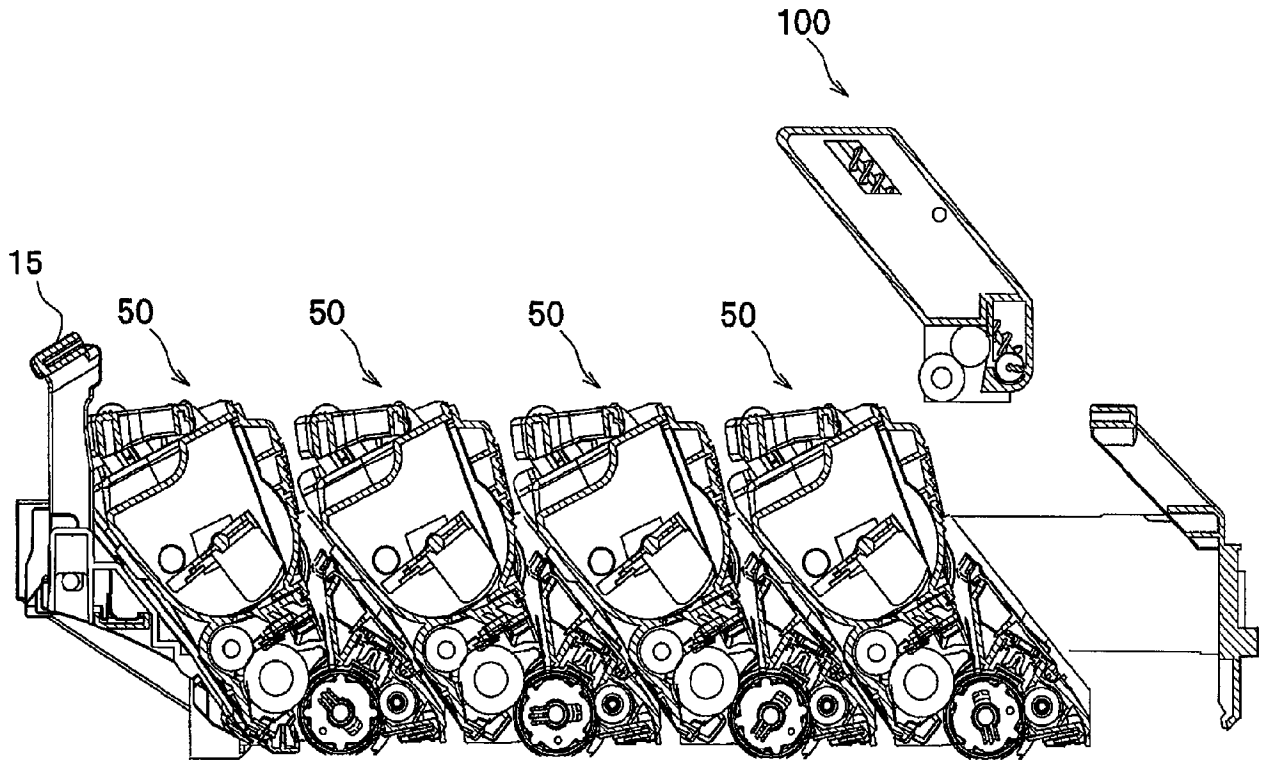
FIG. 7 is a sectional view showing a state in which the cleaning unit has been removed from the drawer unit.

As seen in FIG. 6, when the user performs the maintenance of the cleaning unit 100, the drawer frame 15 is pulled out after the front cover 14 is opened. By this operation, the four process cartridges 50 and the cleaning unit 100 which are mounted to the drawer frame 15 are pulled out from the main body 10 of the color printer 1. Thereafter, as shown in FIG. 7, the cleaning unit 100 is removed from the drawer frame 15 so as to replace it with a new cleaning unit 100 or to dispose of toner T stored in the storage portion 121.

As with the maintenance of the cleaning unit 100, when the user performs the maintenance of the process cartridge 50, the drawer frame 15 is pulled out after the front cover 14 is opened. Thereafter, the process cartridge 50 is removed from the drawer frame 15 to replace it with a new process cartridge 50.

According to the color printer 1 as constructed above, the maintenance of the cleaning unit 100 can be performed by the same manner of operations as that of the process cartridge 50. In other words, the maintenance of the cleaning unit 100 can be readily performed after a simple operation of pulling out the drawer frame 15 in a direction parallel to the sheet conveyance direction.

Further, because the cleaning unit 100 is arranged parallel to the four process cartridges 50, the height of the color printer 1 can be reduced by the height of the cleaning unit 100 compared to the conventional image forming apparatus.

In the color printer 1 according to this embodiment, the cleaning roller 111 is positioned away from the conveyor belt 73 when the leading end of a sheet P passes through the photoconductor drum 53 that is positioned in front of the cleaning roller 111. Therefore, the cleaning roller does not interfere with the conveyance of the sheet P. In other words, the toner image formed on the sheet P is not blurred by the cleaning roller 111.

Second Embodiment

Figure 8:
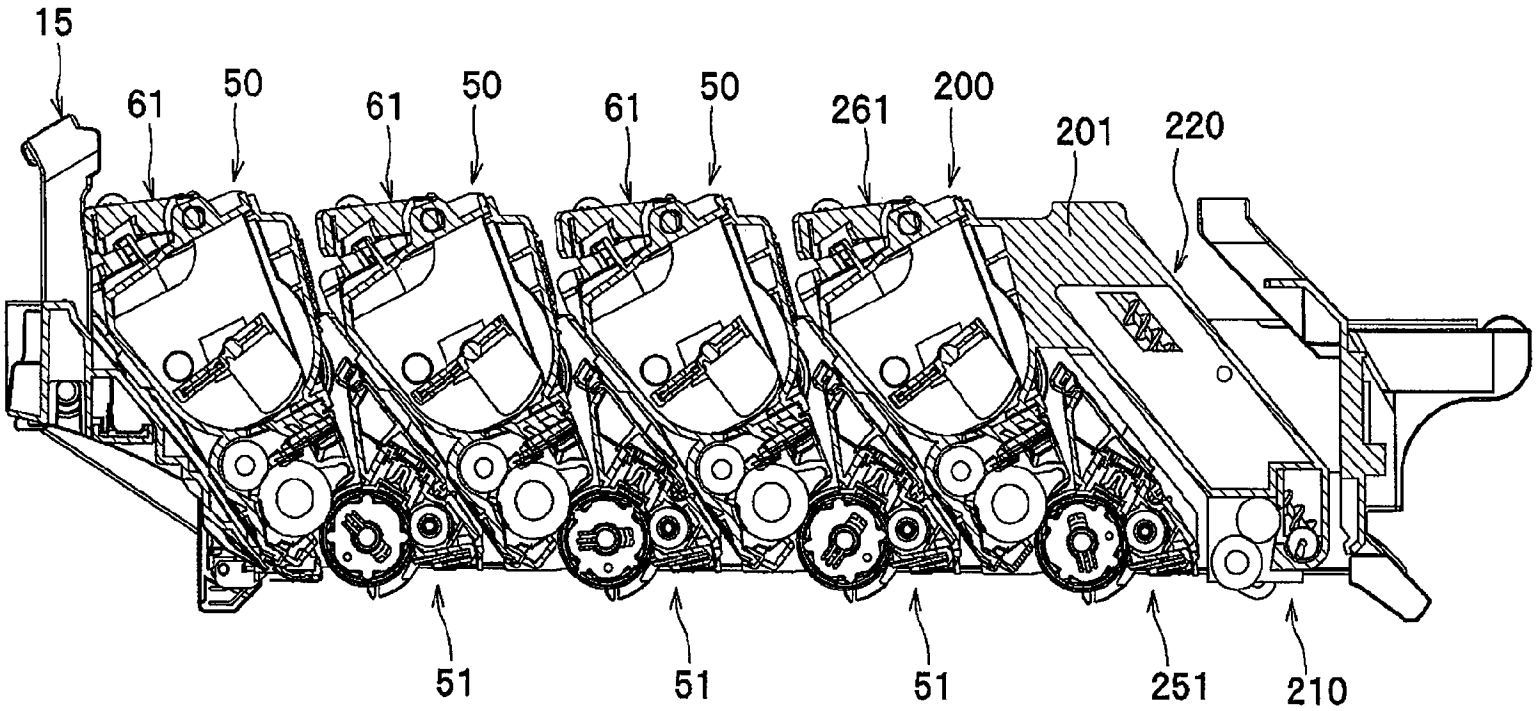
FIG. 8 is a sectional view showing main parts of a color printer according to a second embodiment of the present invention.

A second embodiment of the present invention will be described with reference to FIG. 8. In the following description, parts different from those employed in the first embodiment will be mainly described, and description of like or similar parts will be omitted or briefly stated.

A color printer according to the second embodiment is substantially the same as that of the first embodiment. However, as best seen in FIG. 8, of the four process cartridges 50, 50, 50, 200 arranged tandem in the drawer frame 15, the downstream-most process cartridge 200 positioned at the downstream end along the sheet conveyance passage is different from the corresponding process cartridge 50 according to the first embodiment.

To be more specific, the process cartridge 200 includes a photoconductor cartridge 251, a developing cartridge 261, a cleaner portion 210, and a waste toner box 220. The developing cartridge 261 is integrally formed with the waste toner box 220 through a connecting portion 201. The connecting portion 201 is, for example, a member for connecting a casing of the developing cartridge 261 and a casing of the waste toner box 220. It is noted that the developing cartridge 261 integrally formed with the waste toner box 220 preferably contains black toner T (i.e., a developing cartridge for black toner T).

According to the second embodiment, the waste toner box 220 and the cleaner portion 210 which form a cleaning unit are attached to or detached from the drawer frame 15 together with the developing cartridge 261. Therefore, the maintenance of the cleaning unit is more readily performed. Further, because the waste toner box 220 and the developing cartridge 261 are replaced together, the upper limit of the capacity of the waste toner box 220 can be estimated. This can allow the capacity of the waste toner box 220 to be reduced or this can eliminate the use of means for measuring the amount of toner T in the waste toner box 220. Usually, if the waste toner box 220 and the cleaner portion 210 are integral with the developing cartridge 261, the cleaning roller 111 which is to be positioned in contact with or away from the conveyor belt 73 becomes a problem. However, according to this embodiment, only the cleaning roller 111 is movable while the waste toner box 220 is stationary. Therefore, no problem occurs if the waste toner box 220 and the cleaner portion 210 are integrally formed with the developing cartridge 261 through the connecting portion 201.

Third Embodiment

Figure 9A:
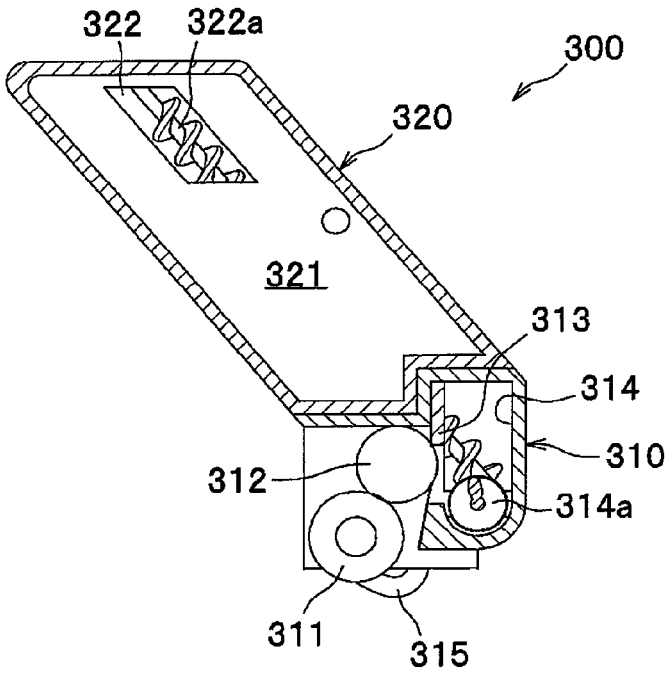

A third embodiment of the present invention will be described with reference to FIGS. 9A and 9B.

Figure 9B:
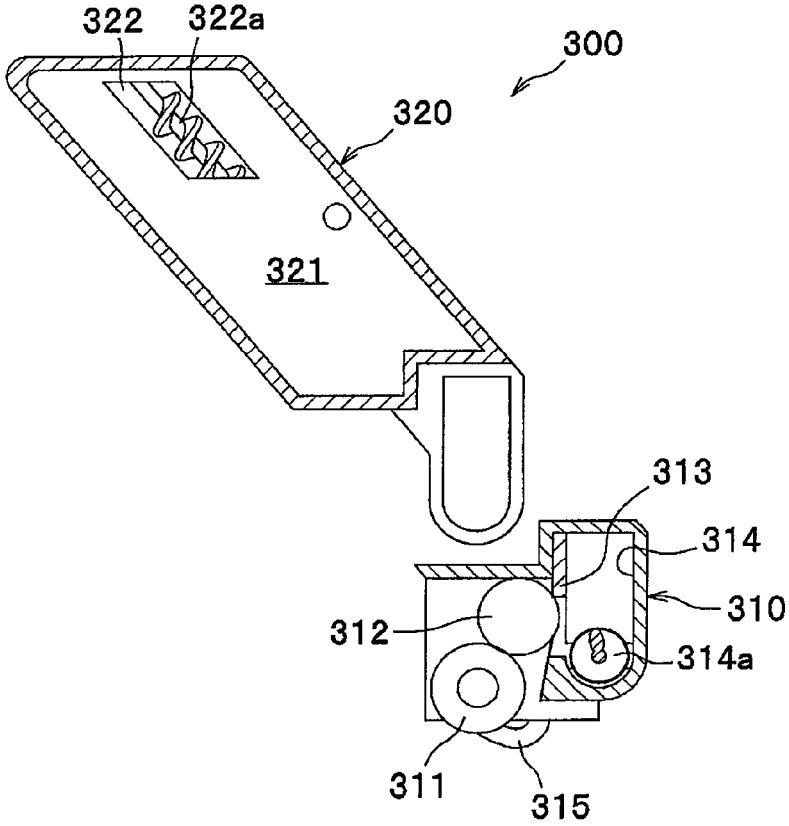

As best seen in FIG. 9B, a cleaning unit 300 according to the third embodiment is different from the cleaning unit 100 according to the first embodiment in that a cleaner portion 310 and a waste toner box 320 are separable from each other.

The cleaner portion 310 includes a cleaning roller 311 as a cleaning member, a collecting roller 312, a blade 313, and a carrier unit 314. A first auger 314*a* is provided inside the carrier unit 314. Further, a rocking member 315 is provided at each side surface of the cleaner portion 310.

The waste toner box 320 includes a storage portion 321, and a waste toner loading portion 322. A second auger 322*a* is provided inside the waste toner loading portion 322. As seen FIGS. 9A and 9B, the second auger 322*a* extends downward beyond the lower end of the waste toner box 320, so that in such a position that the waste toner box 320 is attached to the cleaner portion 310 a lower end portion of the second auger 322*a* is positioned inside the carrier unit 314.

According to the third embodiment, only the waste toner box 320 can be removed from the main body 10 (through the drawer frame 15) during the maintenance of the cleaning unit 300. Therefore, the waste toner box 320 in which waste toner T has been stored is disposed of and instead a new waste toner box 320 can be attached to the cleaner portion 310. Replacement of the waste toner box 320 is a hands clean operation and the user can continue to use the same cleaner portion 310, which can simplify the maintenance as well as reduce the cost.

According to the third embodiment, the cleaner portion 310 may be fixed to the drawer frame 15 so as not to be removed therefrom. This can ease the maintenance of the cleaner portion 310.

Fourth Embodiment

A fourth embodiment of the present invention will be described with reference to FIGS. 10A and 10B.

Figure 10A:
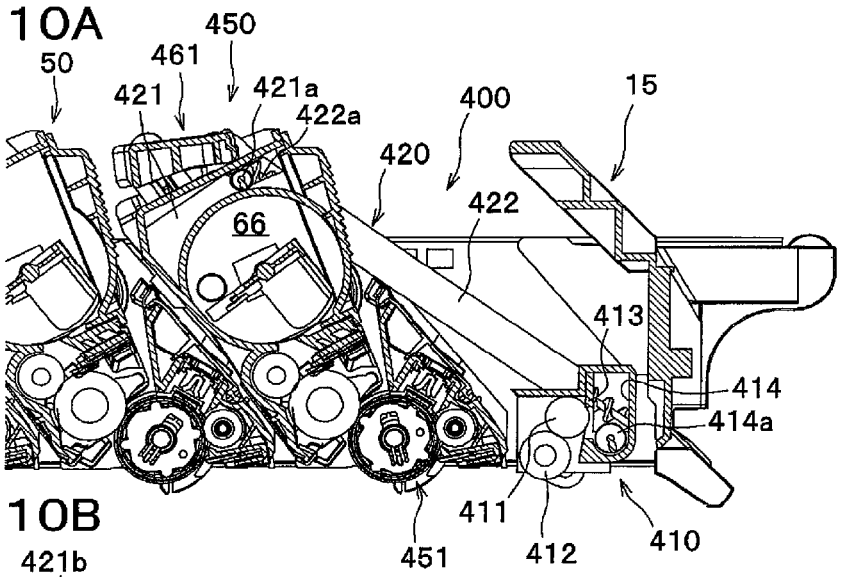
Figure 10B:
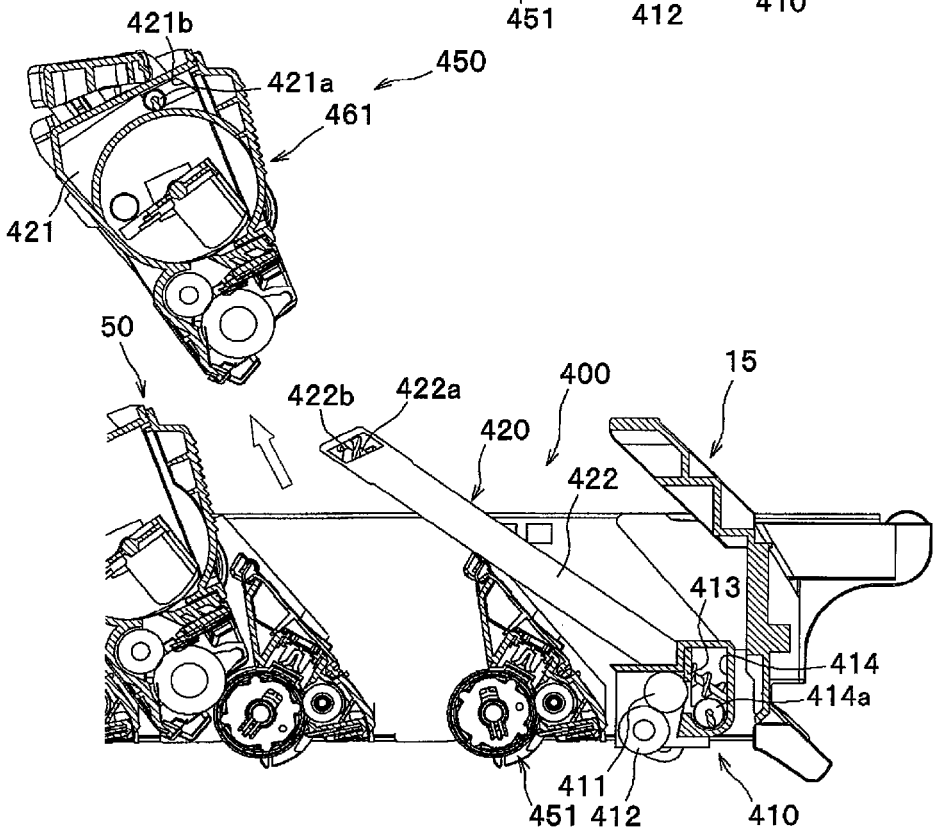

As seen in FIGS. 10A and 10B, a color printer according to the fourth embodiment is different from the color printer 1 according to the first embodiment in that a waste toner box 421 for storing waste toner T is provided not in a cleaning unit 400 but in a developing cartridge 461 of a process cartridge 450 that is adjacent to the cleaning unit 400.

The cleaning unit 400 includes a cleaner portion 410, and a waste toner loading portion 420.

The cleaner portion 410 includes a cleaning roller 411 as an example of a cleaning member, a collecting roller 412, a blade 413, and a carrier unit 414. A first auger 414*a* is positioned inside the carrier unit 414.

The waste toner loading portion 420 is configured to load waste toner T from the carrier unit 414 into the waste toner box 421. The waste toner loading portion 420 extends diagonally upward from the left-side of the cleaner portion 410 toward the process cartridge 450 (the developing cartridge 461) positioned in front of the cleaner portion 410. The waste toner loading portion 420 includes a tubular communication passage 422 connecting the carrier unit 414 and the waste toner box 421, and a second auger 422*a* provided inside the communication passage 422. An opening 422*b* is formed in an upper end portion of the communication passage 422 at its left side.

The process cartridge 450 consists of a photoconductor cartridge 451, and the developing cartridge 461.

The developing cartridge 461 has the waste toner box 421 above the toner storage chamber 66. The waste toner box 421 forms a compartment for storing waste toner T. A third auger 421*a* for carrying waste toner T in the right-and-left direction is provided inside the waste toner box 421. An opening 421*b* for communicating with the communication passage 422 is formed in a left side portion of the waste toner box 421.

As seen in FIG. 10A, when the developing cartridge 461 is set in the drawer frame 15, the upper end of the communication passage 422 is positioned adjacent to the left side surface of the developing cartridge 461. Thereby, the carrier unit 414 and the waste toner box 421 are in communication with each other through the communication passage 422.

According to the fourth embodiment, because the waste toner box 421 is provided inside the developing cartridge 461, replacement of the waste toner box 421 can be performed at the same time as the replacement of the developing cartridge 461. Further, this configuration of the waste toner box 421 allows the cleaning unit 400 to be simplified in construction, and also the cleaning unit 400 can be fixed to the drawer frame 15. In this instance, as with the second embodiment, the required capacity of the waste toner box 421 can be estimated from the capacity of the toner storage chamber 66 of the developing cartridge 461. Therefore, it is possible to reduce the capacity of the waste toner box 421 or to eliminate the use of means for measuring the amount of waste toner T in the waste toner box 421. According to this embodiment, because the waste toner loading portion 420 is stationary while the cleaning roller 411 is movable between the contacting position and the spaced-apart position, it is possible to simplify the construction of the color printer.

Fifth Embodiment

Figure 11:
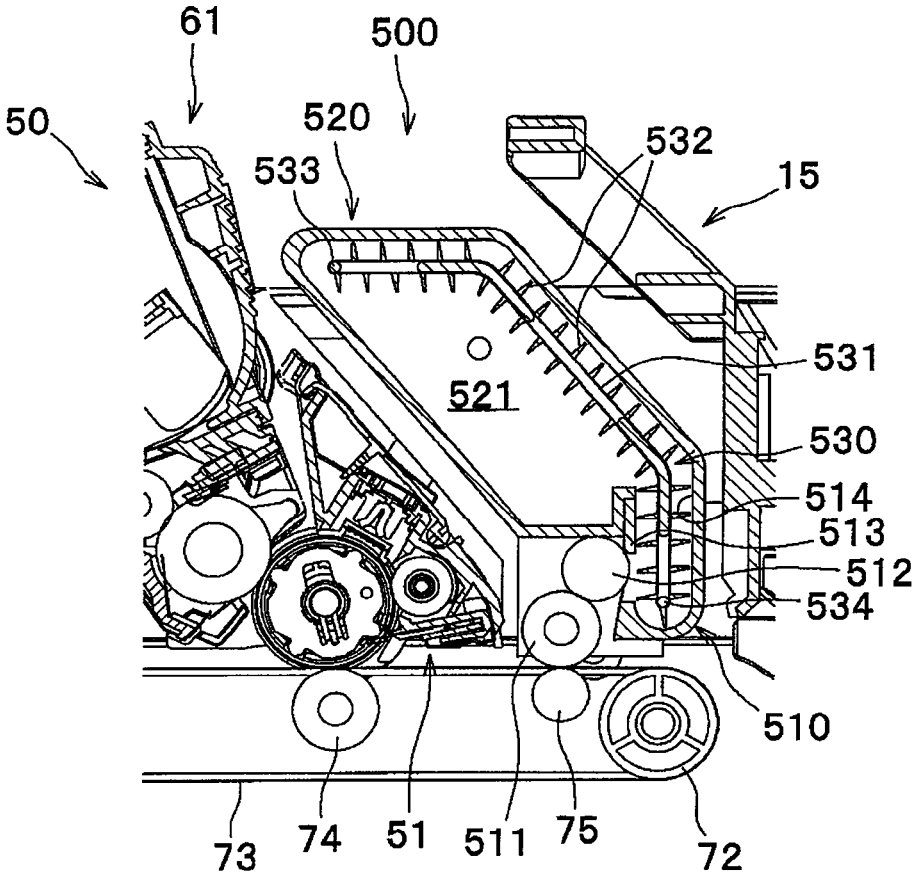
FIG. 11 is an enlarged sectional view showing main parts of a color printer according to a fifth embodiment of the present invention.

A fifth embodiment of the present invention will be described with reference to FIG. 11.

A color printer according to the fifth embodiment is substantially the same as the color printer 1 according to the first embodiment except for a cleaning unit 500. To be more specific, as seen in FIG. 11, the cleaning unit 500 includes a belt-type carrier device 530 in place of the auger as a device for carrying toner T from a cleaner portion 510 to a waste toner box 520.

The cleaning unit 500 includes the cleaner portion 510, and the waste toner box 520.

The cleaner portion 510 includes a cleaning roller 511 as a cleaning member, a collecting roller 512, a blade 513, and a carrier unit 514. An upper end portion of the carrier unit 514 is in communication with a storage portion 521 of the waste toner box 520 and extends in the right-and-left direction. The belt-type carrier device 530 extends across the carrier unit 514 and the storage portion 521.

The carrier unit 514 mainly includes a conveyor belt 531 for conveying adhering substance, a plurality of projections 532, a drive roller 534, and a driven roller 533.

The drive roller 534 extends in the right-and-left direction at a lower end portion of the carrier unit 514 and is driven to rotate by a rotation device (not shown). The driven roller 533 extends in the right-and-left direction at a front and upper end portion of the storage portion 521. The conveyor belt 531 is an endless belt widely extending in the right-and-left direction, and looped around the drive roller 534 and the driven roller 533. The conveyor belt 531 is bent along a rear wall of the carrier unit 514, a rear wall of the storage portion 521, and an upper wall of the storage portion 521. The plurality of projections 532 extend in the right-and-left direction and are equally spaced on the surface of the conveyor belt 531. Toner T supplied into the carrier unit 514 is scooped up using the projections 532 and lifted by the conveyor belt 531 to the upper end portion of the storage portion 521, from which the toner T falls into the storage portion 521.

In the cleaning unit 100 according to the first embodiment, waste toner T is apt to be collected at the left-hand side of the storage portion 121. However, in the cleaning unit 500 according to the fifth embodiment, the belt-type carrier device 530 extending in the right-and-left direction supplies waste toner T entirely along the width of the storage portion 521, so that the toner T can be stored in the storage portion 521 equally in the right-and-left direction without being stored partially at one side thereof.

Sixth Embodiment

A sixth embodiment of the present invention will be described with reference to FIG. 12.

Figure 12:
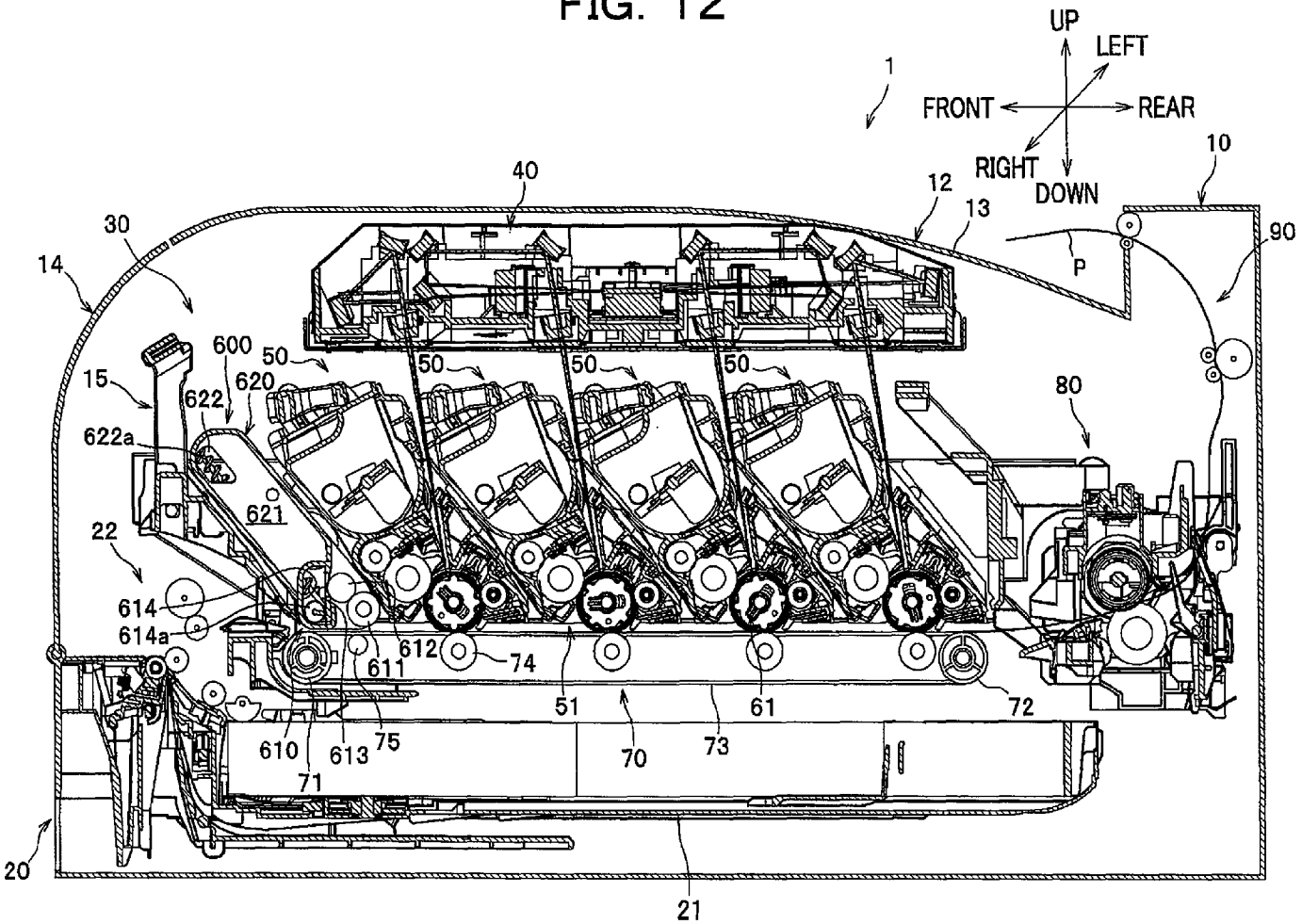
FIG. 12 is a sectional view of a color printer according to a sixth embodiment of the present invention.

As seen in FIG. 12, a color printer 1 according to the sixth embodiment is different from that of the first embodiment in that a cleaning unit 600 is arranged parallel to and upstream from the four process cartridges 50 as seen in the sheet conveyance direction.

The cleaning unit 600 includes a cleaner portion 610, and a waste toner box 620.

The cleaner portion 610 includes a cleaning roller 611 as an example of a cleaning member, a collecting roller 612, a blade 613, and a carrier unit 614. A first auger 614*a* is provided inside the carrier unit 614.

The waste toner box 620 includes a storage portion 621, and a waste toner loading portion 622. A second auger 622*a* is provided inside the waste toner loading portion 622.

A backup roller 75 opposite to the cleaning roller 611 is arranged between the drive roller 71 and the upstream-most transfer roller 74.

For example, the cleaning roller 611 is positioned in contact with the conveyor belt 73 when the sheet feed mechanism 22 is stopped, and is positioned away from the conveyor belt 73 when the sheet feed mechanism 22 is in operation. Whether or not the sheet feed mechanism 22 is in operation can be detected by the controller (not shown).

Figure 13:
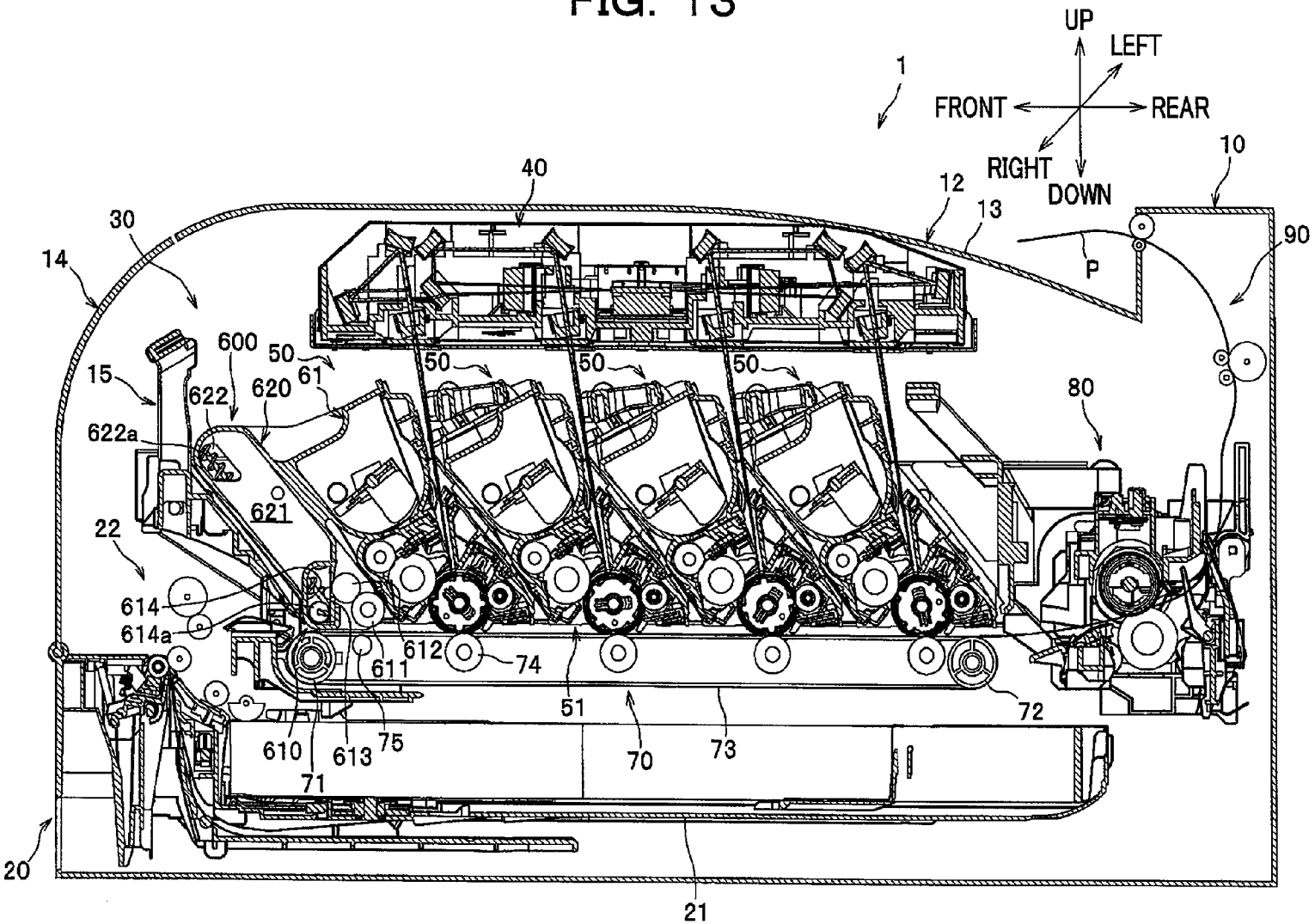
FIG. 13 shows a modification of the color printer of the sixth embodiment.

According to the sixth embodiment, because the cleaning unit 600 is arranged parallel to and upstream from the four process cartridges 50 as seen in the sheet conveyance direction, the height of the color printer 1 can be reduced compared to the arrangement where the cleaning unit 600 is positioned below the transfer unit 70. Further, according to this embodiment, toner T transferred onto the conveyor belt 73 does not pass through the cleaning roller 611 during the measurement of the patch pattern in the patch pattern measurement mode. Therefore, it is not necessary to move the cleaning roller 611 away from the conveyor belt 73. Further, because the waste toner box 620 is adjacent to the developing cartridge 61, as shown in FIG. 13, the waste toner box 620 and the developing cartridge 61 can be readily formed into an integrated structure as with the second embodiment.

Although the present invention has been described in detail with reference to the above embodiments and the accompanying drawings, the present invention is not limited to these specific embodiments and various changes and modifications may be made without departing from the scope of the appended claims.

In the above preferred embodiments, the roller-shaped cleaning roller 111 is employed as a cleaning member. However, the present invention is not limited to this specific construction. For example, a blade-shaped or a brush-shaped cleaning member may be used. However, in order to readily move the cleaning member between the contacting position and the spaced-apart position with respect to the conveyor belt, a roller-shaped cleaning roller is preferable.

In the above preferred embodiments, the present invention has been applied to a color printer. However, the present invention is applicable to other image forming apparatuses such as a copying machine and a multifunction device. Further, the present invention is not limited to an image forming apparatus of the type in which an exposure is made using a laser beam, and the present invention is also applicable to an image forming apparatus in which the exposure device uses other light sources such as an LED.

The invention claimed is:

1. An image forming apparatus comprising:

an image forming unit including a plurality of photoconductor drums arranged in tandem, and a plurality of developer cartridges corresponding to the plurality of photoconductor drums, the plurality of developer cartridges each containing developer having a predetermined color;

a conveyor belt disposed opposite to the plurality of photoconductor drums and configured to convey a recording sheet between the photoconductor drums and the conveyor belt;

a support frame configured to support the plurality of photoconductor drums, the support frame being configured to be movable between an inside position, in which the plurality of photoconductor drums are positioned inside a main body casing of the image forming apparatus, and an outside position, in which the plurality of photoconductor drums are positioned outside the main body casing ; and a cleaning unit disposed on the same side of the conveyor belt as the image forming unit, wherein the cleaning unit comprises a receptacle configured to store waste developer, and a carrying member configured to carry collected waste developer toward the receptacle, and wherein the carrying member is bent and configured to extend in a first direction orthogonal to an axis of rotation of the photoconductor drums and in a second direction orthogonal to the axis of rotation of the photoconductor drums and intersecting with the first direction.

2. The image forming apparatus according to claim 1, further comprising:

a collecting roller configured to collect waste developer, and a blade contacting a peripheral surface of the collecting roller, wherein the carrying member carries waste developer scraped off by the blade toward the receptacle.

3. The image forming apparatus according to claim 2, wherein the collecting roller and the blade are supported by the support frame.

4. The image forming apparatus according to claim 2, wherein the receptacle is detachable from the support frame while the blade and the collecting roller are left in the support frame.

5. The image forming apparatus according to claim 1, further comprising a rotating member configured to drive the carrying member, wherein the rotating member is located at one end of the carrying member.

6. The image forming apparatus according to claim 5, wherein the rotating member is a roller.

7. The image forming apparatus according to claim 1, wherein the second direction has a vertical component.

8. The image forming apparatus according to claim 1, wherein the first direction runs in a vertical direction.

9. The image forming apparatus according to claim 1, wherein the carrying member comprises:

a first portion configured to extend in the first direction; and a second portion extending from the first portion and extending in the second direction.

10. The image forming apparatus according to claim 9, wherein the carrying member further comprises a third portion connected to the second portion and extending in a third direction intersecting with the first direction and the second direction.

11. The image forming apparatus according to claim 1, wherein the carrying member is disposed inside the receptacle.

12. The image forming apparatus according to claim 11, wherein the carrying member is a belt.

13. The image forming apparatus according to claim 12, wherein the carrying member extends along inner surfaces of the receptacle such that the carrying member and the inner surfaces face each other.

14. The image forming apparatus according to claim 1, wherein the receptacle is configured to store waste toner removed from the carrying member.

15. The image forming apparatus according to claim 1, wherein the support frame is horizontally movable between the inside position and the outside position.

16. The image forming apparatus according to claim 1, wherein the carrying member extends in a direction in which the axis of rotation extends.

17. The image forming apparatus according to claim 1, further comprising a fixing unit, wherein the receptacle is disposed between the image forming unit and the fixing unit in a horizontal direction.

* * * * *